US010464075B2

(12) United States Patent
Baldauf et al.

(10) Patent No.: US 10,464,075 B2
(45) Date of Patent: Nov. 5, 2019

(54) FROTH FLOTATION WITH ANISOTROPIC PARTICLE COLLECTORS

(71) Applicant: International Business Machines Corporation, Armonk, NY (US)

(72) Inventors: Julia Baldauf, South Melbourne (AU); Alexe Bojovschi, Lilydale (AU); Benjamin S. Mashford, Malvern East (AU); Christine Schieber, Southbank (AU); George Yiapanis, Northcote (AU)

(73) Assignee: International Business Machines Corporation, Armonk, NY (US)

( * ) Notice: Subject to any disclaimer, the term of this patent is extended or adjusted under 35 U.S.C. 154(b) by 987 days.

(21) Appl. No.: 14/978,411

(22) Filed: Dec. 22, 2015

(65) Prior Publication Data

US 2017/0173594 A1 Jun. 22, 2017

(51) Int. Cl.

| | |
|---|---|
| ***B03D 1/006*** | (2006.01) |
| ***B03D 1/12*** | (2006.01) |
| ***B03D 1/02*** | (2006.01) |

(52) U.S. Cl.

CPC ..... *B03D 1/006* (2013.01); *B03D 1/023* (2013.01); *B03D 1/12* (2013.01); *B03D 2201/02* (2013.01)

(58) Field of Classification Search

CPC ..... B01J 20/3285; B03D 1/006; B03D 1/12; B03D 1/023; B03D 2201/02

See application file for complete search history.

(56) References Cited

U.S. PATENT DOCUMENTS

| | | | | |
|---|---|---|---|---|
| 5,037,534 | A * | 8/1991 | Harrison | B03D 1/002 209/167 |
| 5,059,309 | A | 10/1991 | Jordan | |
| 5,180,511 | A * | 1/1993 | Harrison | B03D 1/002 209/166 |
| 10,155,229 | B2 * | 12/2018 | Baldauf | B03D 1/02 |
| 2017/0014834 | A1 * | 1/2017 | Baldauf | B03D 1/1443 |

FOREIGN PATENT DOCUMENTS

| | | | |
|---|---|---|---|
| AU | 2008200740 | A1 * | 3/2008 |
| WO | 2011/091522 | A1 | 8/2011 |

OTHER PUBLICATIONS

Effect of Pulp Rheology on Flotation: The Nickel Sulfide Ore with Asbestos Gangue System by Isil Kilickaplan—Thesis University of British Columbia (2007) (Year: 2007).*

Chen, J., Lan, L., Chen, Y., "Computational Simulation of Adsorption and Thermodynamic Study of Xanthate, Dithiophosphate and Dithiocarbamate on Galena and Pyrite Surfaces" Minerals Engineering. 2013, 46-47, 136-143.

(Continued)

*Primary Examiner* — Pamela H Weiss

(74) *Attorney, Agent, or Firm* — Grant Johnson

(57) ABSTRACT

In one example, a method includes providing a pulp composed of a combination of particulate materials including particles of a target material. The pulp is mixed with a collector composed of anisotropic particles having at least two separate spatial domains that have different physiochemical properties, and the mixture of pulp and collector is fed into an aqueous solution containing air bubbles.

20 Claims, 3 Drawing Sheets

(56) References Cited

OTHER PUBLICATIONS

Lemanowicz, M., Jach, Z., Kilian, E., Gierczycki, A., "Ultra-Fine Coal Flocculation Using Dual-PolYIner Systems of Ultrasonically Conditioned and Unmodified Flocculant", Chemical Engineering Journal 168 , 2011,159-169.

Tao, D., "Role of Bubble Size in Flotation of Coarse and Fine Particles-A Review", Separation Science and Technology, 39:4, 741-760.

Walther, A., Mu, A. H. E., Janus Particles: Synthesis 1 Self-Assembly, Physical Properties, and Applications, Apr. 2013, Chemical Reviews, 5194-5261.

Lattuada, M., Hatton, T. A., "Synthesis, Properties and Applications of Janus Nanoparticles", Nano Today 2011, 6 , 286-308.

Nguyen, A. V., Schulze, H. J, Ralston, J., "Elementary Steps in Particle-bubble attachment", Int. J. Miner. Process. 51, 1997 ,183-195.

Yang, H., Liang, F., Chen, Y., Wang, Q., Qu, X., Yang, Z., "Lotus Leaf Inspired Robust Superhydrophobic Coating from Strawberry-like Janus Particles", NPG Asia Materials 7, 2015, e176.

Fernandez-Rodriguez, M. A., Rodriguez-Valverde, M. A., Cabrerizo-Vflchez, M., Hidalgo-Alvarez, R., "Surface Activity and Collective Behaviour of Colloidally Stable Janus-like Particles at the Air-Water Interface", Soft Matter 2014,10, 3471-3476.

Sashuk, V., Holyst, R., Wojciechowski, T., Fialkowski, M., "Close-Packed Monolayers of Charged Janus-Type Nanoparticles at the Air-Water Interface", Journal Colloid Interface Sci. 2012,375 ,180-186.

Isojima, T., Lattuada, M., Vander Sande, J. , Hatton, T. A., "Reversible Clustering of pH- and Temperature-Responsive Janus Magnetic Nanoparticles", ACS Nano vol. 2, No. 9, 2008, 1799-1806.

Ozkan, S. G., Gungoren, C., "Enhancement of Colemanite Flotation by Ultrasonic Pre-Treatment", Physicochemical Problems of Mineral Processing 48(2), 2012, 455-462.

Cilek, E C., Ozgen, S., "Improvement of the Flotation Selectivity in a Mechanical Flotation Cell by Ultrasound", Separation Science and. Technology, 45:4, 2010, 572-579.

Celik, M. S., "Effect of Ultrasonic Treatment on the Floatability of Coal and Galena", Separation Science Technology, 1989, 24:14,1159-1166.

Ozkan, S. G., Kuyumcu, H. Z., "Investigation of Mechanism of Ultrasound on Coal Flotation", Int. J. Miner. Process. 81, 2006, 201-203.

Xu, Q., Nakajima, M., Ichikawa, S., Nakamura, N., Shiina, T., "A Comparative Study of Microbubble Generation by Mechanical Agitation and Sonication," Innovative Food Science and Emerging Technologies 9, 2008, 489-494.

* cited by examiner

FROTH FLOTATION WITH ANISOTROPIC PARTICLE COLLECTORS

FIELD OF THE DISCLOSURE

The present disclosure relates generally to froth flotation and relates more specifically to froth flotation techniques that are aided by the use of collectors.

BACKGROUND OF THE DISCLOSURE

Froth flotation is a process that is used in many industries for selectively separating hydrophobic and hydrophilic materials. Generally, the process works by passing air bubbles through an aqueous suspension of a "pulp" that contains the materials to be separated (e.g., target mineral particles and unwanted material). Through conditioning of the target mineral particles, it is possible to induce preferential attachment of the target mineral particles to the air bubbles. The air bubbles and attached mineral particles float to the surface of the aqueous suspension as "froth" (which may be subsequently removed), whereas the unwanted material does not float to the surface and becomes the "tailings" of the process.

In some cases, small molecules called "collectors" may be added to the pulp to selectively adsorb (e.g., through chemisorption or physisorption) onto the target mineral particles' surfaces and render the target mineral hydrophobic. Thus, a purpose of a collector is to selectively hydrophobize a target mineral so that the target mineral can attach to the air bubbles and float to the surface of the aqueous suspension. Collectors may be classified as nonionic, anionic, or cationic, and are typically selected based on the target mineral. For instance, if a sulfide mineral is the target mineral, then a sulfhydryl collector or a thiol collector might be selected (e.g., xanthates, dithiophosphates, dithiocarbamates). The efficacy of the separation achieved by the froth flotation process can therefore be significantly impacted by the selection of the collector.

SUMMARY OF THE DISCLOSURE

In one example, a method includes providing a pulp composed of a combination of particulate materials including particles of a target material. The pulp is mixed with a collector composed of anisotropic particles having at least two separate spatial domains that have different physiochemical properties, and the mixture of pulp and collector is fed into an aqueous solution containing air bubbles.

In another example, a system includes a mixing chamber, a source of a collector, and a flotation chamber. The mixing chamber includes a first feed line coupled to a source of a pulp and a second feed line coupled to the source of a collector. The source of the collector includes anisotropic particles having at least two separate spatial domains that have different physiochemical properties. The flotation chamber includes a third feed line coupled to a source of air and a fourth feed line coupled to an output of the mixing chamber.

BRIEF DESCRIPTION OF THE DRAWINGS

The teachings of the present disclosure can be readily understood by considering the following detailed description in conjunction with the accompanying drawings, in which.

To facilitate understanding, identical reference numerals have been used, where possible, to designate identical elements that are common to the Figures.

DETAILED DESCRIPTION

Figure 1:
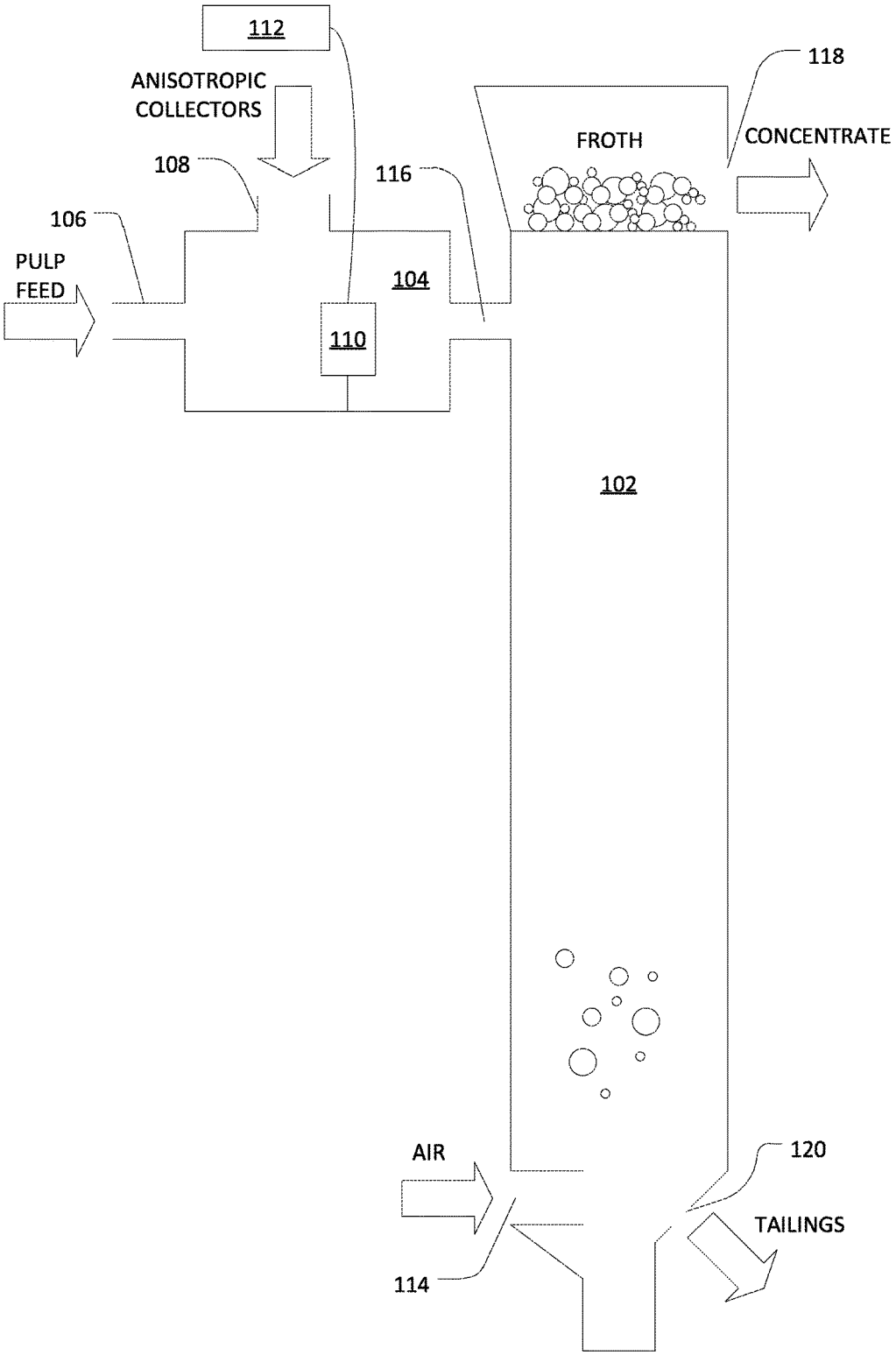
FIG. 1 illustrates a block diagram of an example of a froth flotation system.

In one example, a method and apparatus for froth flotation using anisotropic particle collectors is disclosed. As discussed above, conventional froth flotation processes pass air bubbles through an aqueous suspension of pulp and, optionally, collectors in order to facilitate the separation of target particles from unwanted materials. The efficacy of the separation achieved by the froth flotation process can be significantly impacted by the selection of the collector, which selectively hydrophobizes the target minerals to be collected. The general composition of a conventional molecular collector is a homogenous hydrocarbon chain having a reactive or functional head group. The head group reacts with the target mineral surface, while the hydrocarbon chain is orientated away from the target mineral surface, toward the aqueous suspension for subsequent attachment to an air bubble.

In some cases, nanoparticles can be used as collectors. These nanoparticles may be treated with surface ligand ionic functional groups that selectively adsorb the nanoparticles onto the target minerals. However in some cases, the addition of the ionic functional groups to homogenous particulate collectors can also decrease the surface hydrophobicity of the collectors, which actually inhibits flotation of the target minerals. Thus, the optimization and selection of collector properties involves balancing competing goals: absorption of the collector onto charged target particle surfaces versus attachment of the collector onto non-polar hydrophobic air bubbles.

Examples of the present disclosure employ collectors composed of anisotropic particles, also referred to as "Janus" particles. Anisotropic particles are particles with asymmetric properties, induced either by anisotropic structure or by anisotropic distribution of functional groups. Thus, an anisotropic particle comprises two or more spatial domains having different physiochemical properties. A simple example of an anisotropic particle is a spherical geometry comprising two distinct hemispheres, where each hemisphere is made up of different materials or bears different functional groups. However, anisotropic particles may come in other shapes as well, including cylindrical, strawberry, and dumbbell-shaped. In examples of the present disclosure, a first part of the anisotropic particle selectively adsorbs to the surface of a target particle, while a second part of the anisotropic particle selectively adsorbs to air bubbles (e.g., via hydrocarbon chains and/or other hydrophobic domains of sufficient size). Anisotropic particles can thus combine the advantages of dual functionality (inherent in low-molecular-weight collectors or surfactants) and nano- and/or micro-scale particle characteristics (e.g., increased surface-to-volume ratio, hierarchical surface structure, etc.). The contrasts between spatial domains in anisotropic particles can improve the particles' affinity for air-water interfaces, ability to self-assemble at surfaces, and tunable amphiphilic properties.

Examples of the present disclosure may be advantageously implemented in any application that involves froth flotation processes, including separation of sulfide minerals from silica, separation of coal from ash-forming minerals, de-inking recycled newsprint, or removing bacteria and other substances from wastewater.

One particular application that may benefit from examples of the present disclosure is ore beneficiation. Prior to froth flotation, the ore to be treated is reduced to fine particles by crushing and grinding, so that the various minerals exist as physically separate grains. This process is referred to as "liberation." The rapid decline of ore grades is forcing finer grinding to achieve suitable liberation levels. With the increased presence of ultrafine particles comes an increasing urgency to develop efficient ways of enhancing fine particle flotation. For instance, fine particles exhibit low collision efficiency with conventional air bubbles, which may lead to the particles being lost to tailings rather than floated in the froth.

On the other hand, flotation of coarser particles is being looked to as an option to reduce processing costs. The grinding process represents a major cost in mineral processing, and techniques that reduce the need for grinding can reduce the overall processing costs. However, some particles may be too coarse to attach to air bubbles, and consequently too coarse to float.

The disclosed system and process improves the ability to float and collect both very fine and very coarse particles. FIG. 1 illustrates a block diagram of an example of a froth flotation system 100. The froth flotation system 100 may be configured to collect particulate materials (e.g., target minerals) via column flotation using a combination of anisotropic particles and ultrasound sonication. As illustrated, the froth flotation system 100 generally comprises a flotation cell 102 coupled to a mixing chamber 104.

The mixing chamber 104 comprises a chamber including at least a first feed line 106 and a second feed line 108. The first feed line 106 may be used for injecting a pulp (i.e., a mixture of particulate materials to be separated and an aqueous carrier such as water) from a pulp source, while the second feed line 108 may be used for injecting a collector from a collector source. In another example, a single feed line may be used to inject both the pulp and the collector into the mixing chamber 104, or more than two feed lines may be used.

In one example, the collector that is injected via the second feed line 108 is an anisotropic collector comprising two or more separate or distinct spatial domains. The pulp and the collector thus mix in the mixing chamber 104, where a first spatial domain of the collector adsorbs to the surfaces of target particles (e.g., particles of a target mineral).

Figure 2:
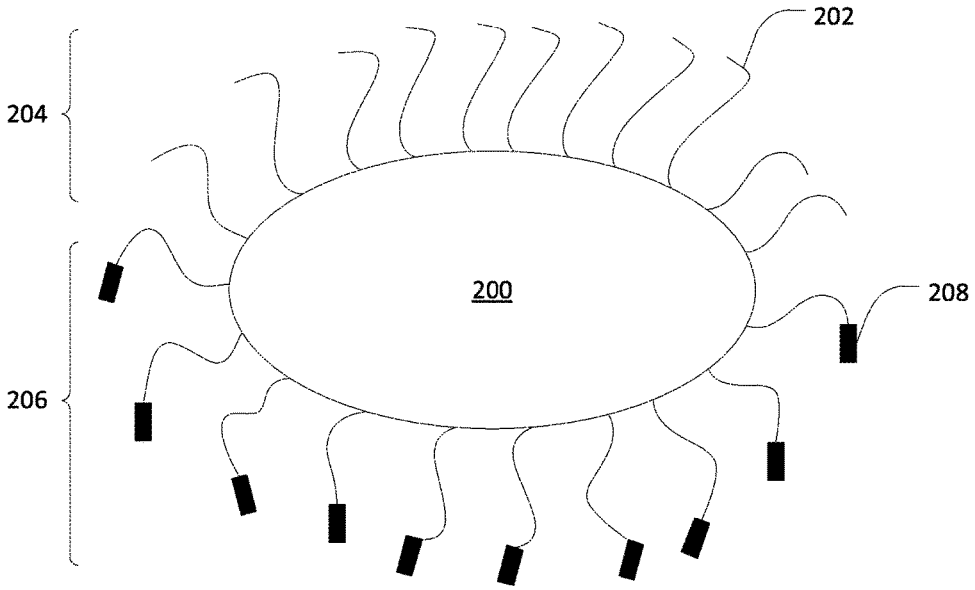
FIG. 2 illustrates an example anisotropic collector particle that may be injected into the froth flotation system of FIG. 1.

FIG. 2, for instance, illustrates an example anisotropic collector particle 200 that may be injected into the froth flotation system of FIG. 1. As illustrated, the anisotropic collector particle 200 comprises a plurality of hydrocarbon chains 202. A subset of these hydrocarbon chains 202 further include functional groups 208 that selectively adsorb the anisotropic collector particle 200 to the surface of a target mineral (e.g., through chemisorption or physisorption). The mechanism of adsorption may include electrostatic interaction, complexation, chemical bond formation, hydrogen bonding, Van der Waals interaction, hydrophobic interaction, or a combination of one or more of these mechanisms. The means of adsorption may depend on the nature of the target mineral. For example, anionic functional groups can be used to adsorb onto positively charged material. Functional groups that can form complexes with the target material (e.g., carboxyl groups, sulfate groups, phosphate groups, primary, secondary, and tertiary amines, imidazole groups, histidine groups, thiourea groups, and/or xanthates) can also be used. In further examples, the functional groups can be bonded covalently to the anisotropic particles post-synthesis or can be incorporated during synthesis (e.g., by masking, self-assembly, and/or phase separation).

The hydrocarbon chains 202 that do not include the functional groups 208 comprise hydrophobic domains or moieties that aid in attaching the anisotropic collector particle 200 to air bubbles. These hydrophobic domains may include non-polar hydrocarbons (e.g., saturated, unsaturated, cyclic, and/or aromatic), which lower the surface energy of the target mineral.

Thus, the hydrocarbon chains 202 that do not include the functional groups 208 represent a first spatial domain 204 of the anisotropic collector particle 200, while the hydrocarbon chains 202 that do include the functional groups 208 represent a second spatial domain 206 of the anisotropic collector particle 200. The two different spatial domains 204 and 206 thus serve two different purposes. In one example, the electrical charge of the second spatial domain 206 (i.e., the hydrophilic domain) is controlled to minimize aggregation of the collector particles in solution. Furthermore, the hydrocarbon chains 202 of the first spatial domain 204 (i.e., the hydrophobic domain) may be designed to introduce a steric effect between collector particles.

The anisotropic collector particle 200 may comprise a magnetic or non-magnetic core, depending on the nature of the target mineral. For instance, a multicomponent ore mixture treated with magnetic and non-magnetic anisotropic collector particles would enable straightforward separation of components based on magnetism. The diameter of the anisotropic collector particle 200 may be in the nano- to micro-meter range.

Figure 3:
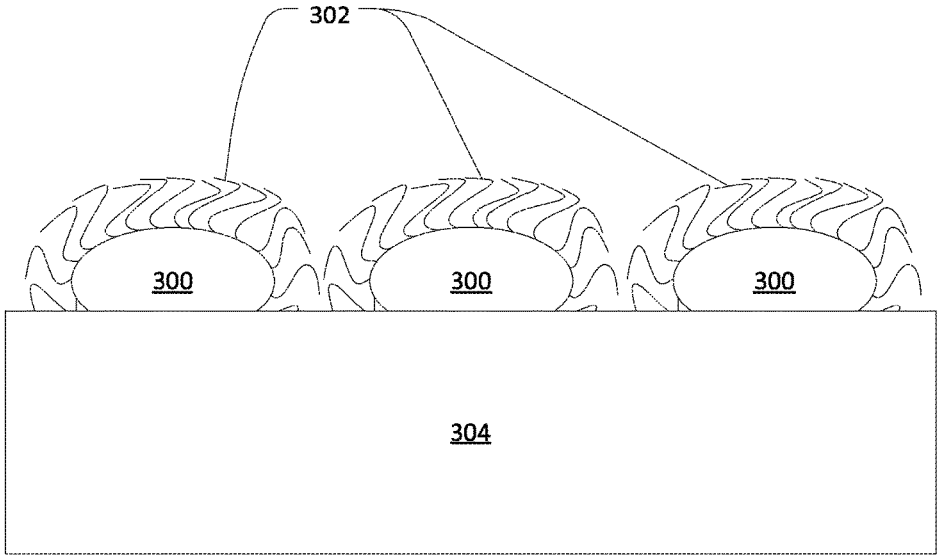
FIG. 3 illustrates a hierarchical surface structure attained through an example adsorption of anisotropic particle collectors similar to the collector illustrated in FIG. 2.

In one example, the anisotropic particle collector 200 and its hydrophobic domains are designed to provide a hierarchical surface structure that resembles the surface structure of the super-hydrophobic lotus leaf. FIG. 3, for example, illustrates a hierarchical surface structure attained through an example adsorption of anisotropic particle collectors similar to the collector 200 illustrated in FIG. 2. As illustrated, protrusions of micro-sized anisotropic particles 300 from the surface 304 of a target mineral create micro-scale surface roughness, while extensions of the nano-sized hydrophobic domains 302 create a finer nano-scale roughness. The result is a super-hydrophobic dual-length surface structure comprising micro-scale roughness decorated with nano-scale irregularities. Such a configuration may lower the surface energy of the target mineral and strengthen the target mineral's attachment to air bubbles as determined by the Young-Dupré equation. Moreover, the dual-lengthy roughness may promote film rupturing, since less film drainage is required prior to rupture. Film rupture is a critical step in the attachment of target mineral particles to air bubbles.

In another example, at least a portion of an anisotropic collector particle is treated with a robust super-hydrophobic coating. For instance, a strawberry- or hemispherical-shaped anisotropic particle can be fabricated in which the flat or smooth surfaces of the particle comprise imidazolin groups (which form covalent bonds with a substrate). The curved or coarse surfaces of the particle may comprise polystyrene. Such an anisotropic particle has experimentally demonstrated the capability to self-organize into a layer on a substrate, resulting in a hierarchical surface structure resembling that illustrated in FIG. 3.

Referring back to FIG. 1, in one example, the mixing chamber 104 further includes an ultrasound sonicator 110 (comprising, e.g., one or more ultrasound sonification probes) positioned within the chamber. The ultrasound sonicator 110 may be coupled to a controller 112, which may be located outside of the mixing chamber 104. The controller 112 is operable to adjust the power of the ultrasound sonicator 110 (e.g., in response to the volume of pulp or to other parameters). Thus, the controller 112 may control the duration, location, and/or power of any ultrasonic pulses emitted by the ultrasound sonicator 110. The controller 112 may be implemented in a computing device.

The flotation cell 102 comprises a hollow, elongate column which in operation is filled with an aqueous solution. The column includes a third feed line 114 for the introduction of air from an air source into the column and a fourth feed line 116 that delivers the mixture of pulp and collector from an output of the mixing chamber 104 into the column. In other examples, more of fewer feed lines may be included in the column.

In addition, the column includes a first collection point 118 and a second collection point 120. In one example, the first collection point 118 and the second collection point 120 are located at opposite ends of the column. For instance, the first collection point 118 may be located at the top of the column, while the second collection point 120 may be located at the bottom of the column.

The mixture of pulp and collector comes into contact with air bubbles inside the flotation cell 102, where a second spatial domain of the collector adsorbs to the air bubbles, thereby attaching the target particles to the air bubbles. The air bubbles carry the target particles to the top of the flotation cell 102, where they form a froth. The target particles may then be collected (e.g., via the first collection point 118) as a concentrate. Other components of the pulp, to which the collector does not adsorb, do not attach to the air bubbles, and thus remain at or near the bottom of the flotation cell 102. These components may be collected (e.g., via the second collection point 120) as the tailings.

Figure 4:
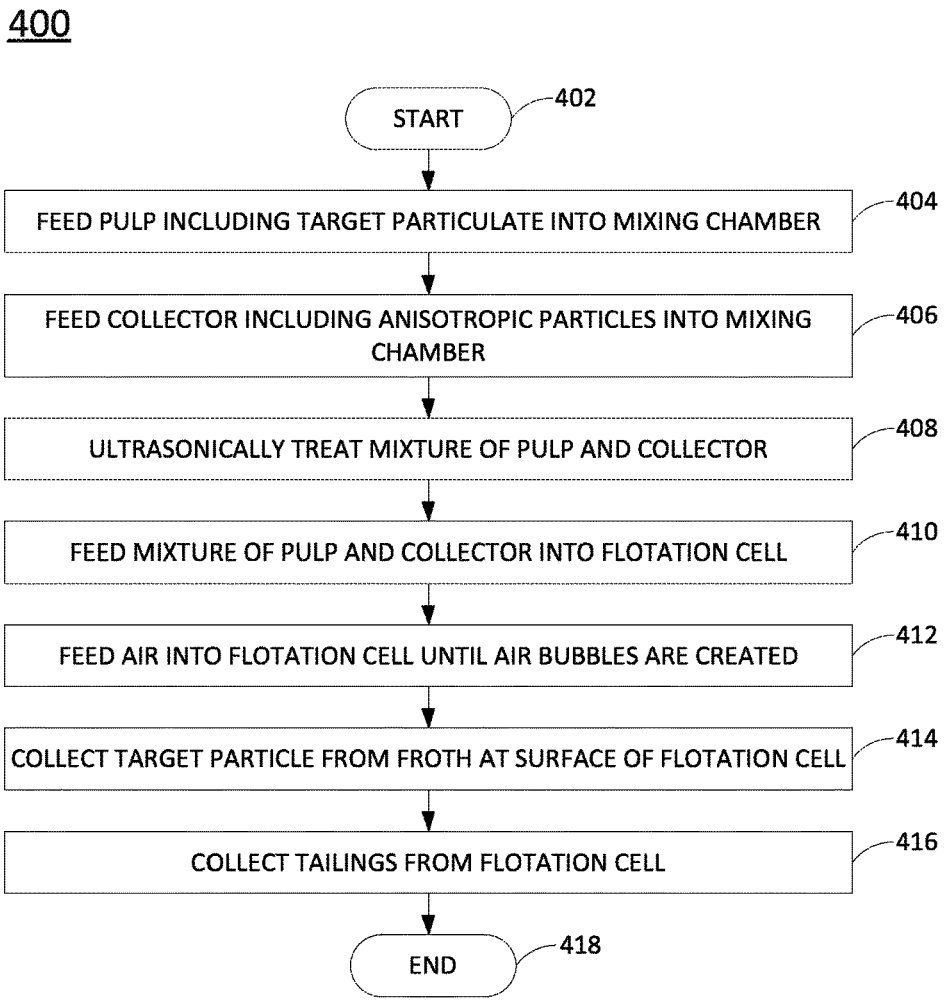
FIG. 4 is a flow diagram illustrating one example of a method for collecting a target particulate from a mixture.

FIG. 4 is a flow diagram illustrating one example of a method 400 for collecting a target particulate from a mixture. The method 400 may be implemented, for example, using the froth flotation system 100 of FIG. 1. As such, reference is made in the discussion of the method 400 to various components of the system 100. However, it will be appreciated that the method 400 may also be implemented in systems having configurations that differ from what is shown in FIG. 1.

The method 400 begins in step 402. In step 404, a pulp is fed into the mixing chamber 104. The pulp comprises a mixture of particulate materials to be separated (including the target particulate), and may also comprise an aqueous carrier such as water.

In step 406, a collector is fed into the mixing chamber and mixes with the pulp. In one example, the collector is an anisotropic collector having two or more spatial domains. The collector particles may be prepared by masking, phase separation, self-assembly, or theory techniques. In one example, the collector particles are prepared from one or more inorganic materials such as silica, silicone, metallic particles, magnetic particles, or aluminates. In another example, the collector particles are prepared from one or more organic materials, such as polystyrene, polyolefins, or co-polymers. In another example, the collector particles are prepared from a combination organic, inorganic, metallic, and magnetic materials. Such combinations of materials can include gold-magnetite particles and silica-polystyrene particles, among others.

As the pulp and the collector mix in the mixing chamber 104, a first spatial domain of the collector adsorbs to the surfaces of the target particles in the pulp. Thus, the specific anisotropic particle making up the collector may be chosen based at least in part on the propensity of the first spatial domain to selectively adsorb to the target particle.

In optional step 408 (illustrated in phantom), the mixture of pulp and collector is ultrasonically treated, for example via pulsed sonication from the ultrasound sonicator 110 operating under the control of the controller 112. Ultrasound sonification may disperse the collector particles and minimize any tendency of the collector particles to agglomerate, thereby making it easier for the collector particles to adsorb to the target particles. Ultrasound sonification may also aid in the separation of unwanted particulates from the target particles. In one example, the ultrasound sonification is focused on only a portion of the mixing chamber 104 (e.g., only the first feed line 106 and/or the second feed line 108). In a further example the ultrasonic treatment lasts only long enough to sufficiently disperse the collector particles.

In step 410, the mixture of pulp and collector is fed into the flotation cell 102 and mixes with an aqueous solution in the flotation cell 102.

In step 412, air is fed into the floatation chamber 102 (e.g., via third feed line 114). This creates air bubbles in the flotation chamber 102. A second spatial domain of the collector attaches to the air bubbles (e.g., via hydrocarbon chains or other hydrophobic domains of sufficient size). Thus, the specific anisotropic particle making up the collector may be chosen based at least in part on the propensity of the second spatial domain to selectively adsorb to air bubbles. As the air bubbles rise to the surface of the flotation cell, they carry the collector and adsorbed target particles with them. The air bubbles, collector, and target particle form a froth on the surface of the flotation cell 102.

In step 414, the target particle is collected as a concentrate from the froth (e.g., by skimming or other means), for example at or near the first collection point 118 of the flotation cell 102.

In step 416, components of the pulp to which the collector did not adsorb are collected as tailings, for example at or near the second collection point 120 of the flotation cell 102.

The method 400 ends in step 418.

Thus, the use of anisotropic particles in the collector improves the collection of a target particle by providing a collector with at least two spatial domains that serve two different functions (i.e., adsorption to the target particle and attachment to air bubbles). This makes the disclosed system and process especially useful for applications in which very fine or very coarse particles are to be collected, where these competing functions typically must be balanced against each other, and selection of the collector may involve optimizing one functionality at the expense of the other. The dual functionality of anisotropic particles allows them to achieve both functions without sacrificing one for the other.

Although various embodiments which incorporate the teachings of the present invention have been shown and described in detail herein, those skilled in the art can readily devise many other varied embodiments that still incorporate these teachings.

What is claimed is:

1. A method comprising:

providing a pulp comprising a combination of particulate materials including particles of a target material;

mixing the pulp with a collector comprising anisotropic particles having at least two separate spatial domains that have different physiochemical properties, wherein a first domain of the at least two separate spatial domains is hydrophobic, and a second domain of the at least two spatial domains is hydrophilic, and wherein at least some particles of the anisotropic particles comprise:

a plurality of hydrocarbon chains; and functional groups borne on a first subset of the plurality of hydrocarbon chains;

and, wherein the at least some particles of the anisotropic particles are arranged to provide a hierarchical surface structure comprising:

a micro-scale surface comprising bodies of the at least some particles of the anisotropic particles;

a nanoscale surface extending from the micro-scale surface and comprising at least some of the plurality of hydrocarbon chains; and feeding a mixture of the pulp and the collector into an aqueous solution containing air bubbles.

2. The method of claim 1, wherein the functional groups selectively adsorb the at least some of the particles to the particles of the target material.

3. The method of claim 2, wherein a mechanism of adsorption that selectively adsorbs the at least some of the particles to the particles of the target material comprises electrostatic interaction.

4. The method of claim 2, wherein a mechanism of adsorption that selectively adsorbs the at least some of the particles to the particles of the target material comprises complexation.

5. The method of claim 2, wherein a mechanism of adsorption that selectively adsorbs the at least some of the particles to the particles of the target material comprises chemical bond formation.

6. The method of claim 2, wherein a mechanism of adsorption that selectively adsorbs the at least some of the particles to the particles of the target material comprises hydrogen bonding.

7. The method of claim 2, wherein a mechanism of adsorption that selectively adsorbs the at least some of the particles to the particles of the target material comprises Van der Waals interaction.

8. The method of claim 2, wherein a mechanism of adsorption that selectively adsorbs the at least some of the particles to the particles of the target material comprises hydrophobic interaction.

9. The method of claim 1, wherein a second subset of the plurality of hydrocarbon chains not including the functional groups attaches the at least some of the particles to the air bubbles.

10. The method of claim 1, wherein the second subset comprises non-polar hydrocarbons.

11. The method of claim 1, wherein a diameter of the anisotropic particles is in the nanometer to micrometer range.

12. The method of claim 1, wherein at least a portion of at least some of the anisotropic particles is treated with a hydrophobic coating.

13. The method of claim 1, wherein the mixing comprises:

ultrasonically treating the mixture of the pulp and the collector prior to feeding the mixture of the pulp and the collector into the aqueous solution.

14. A method comprising:

providing a pulp comprising a combination of particulate materials including particles of a target material;

mixing the pulp with a collector comprising anisotropic particles having at least two separate spatial domains that have different physiochemical properties, wherein at least a portion of at least some of the anisotropic particles is treated with a hydrophobic coating; and feeding a mixture of the pulp and the collector into an aqueous solution containing air bubbles.

15. The method of claim 14, wherein a first domain of the at least two separate spatial domains is hydrophobic, and a second domain of the at least two spatial domains is hydrophilic.

16. The method of claim 15, wherein at least some particles of the anisotropic particles comprise:

a plurality of hydrocarbon chains; and functional groups borne on a first subset of the plurality of hydrocarbon chains.

17. The method of claim 16, wherein a second subset of the plurality of hydrocarbon chains not including the functional groups attaches the at least some of the particles to the air bubbles.

18. The method of claim 16, wherein the second subset comprises non-polar hydrocarbons.

19. The method of claim 14, wherein a diameter of the anisotropic particles is in the nanometer to micrometer range.

20. The method of claim 14, wherein the mixing comprises:

ultrasonically treating the mixture of the pulp and the collector prior to feeding the mixture of the pulp and the collector into the aqueous solution.

* * * * *